US005359158A

United States Patent [19]

Queen

[11] Patent Number: 5,359,158

[45] Date of Patent: Oct. 25, 1994

[54] CEILING-MOUNTED LOUDSPEAKER

[75] Inventor: Daniel L. Queen, New York, N.Y.

[73] Assignee: Sonic Systems, Inc., Stamford, Conn.

[21] Appl. No.: 170,454

[22] Filed: Dec. 20, 1993

Related U.S. Application Data

[63] Continuation of Ser. No. 854,949, Mar. 23, 1992, abandoned.

[51] Int. Cl.[5] ..... H05K 5/00

[52] U.S. Cl. ..... 181/150; 181/152; 181/153; 181/155; 181/156

[58] Field of Search ..... 181/150, 151, 152, 153, 181/154, 155, 156; 381/88, 90, 100

[56] References Cited

U.S. PATENT DOCUMENTS

| | | | |
|---|---|---|---|
| 2,096,192 | 10/1937 | Moore | 181/150 |
| 3,595,337 | 7/1971 | Furey et al. | 181/150 |
| 4,013,846 | 3/1977 | Krawczak et al. | 181/150 X |
| 4,310,065 | 1/1982 | Kayman | 181/159 |
| 4,620,317 | 10/1985 | Anderson | 181/155 X |
| 4,832,150 | 5/1987 | Just et al. | 181/150 X |
| 4,907,071 | 3/1990 | Wiley | 181/156 |
| 4,928,788 | 5/1990 | Erickson | 181/150 X |

*Primary Examiner*—M. L. Gellner
*Assistant Examiner*—Khanh Dang
*Attorney, Agent, or Firm*—Amster, Rothstein & Ebenstein

[57] ABSTRACT

A ceiling-mounted loudspeaker includes upper and lower sound-directing structures having walls acting as a radial horn to provide a wide included angle of coverage for sound energy generated by a loudspeaker driver assembly having a piston for directing generated sound energy upwardly into the horn. The lower structure further has a continuously convex bottom configured and dimensioned to define a diffraction path for at least some of the sound energy exiting the output mouth of the radial horn, so that the convex bottom acts as a downwardly-directed diffractor. The radial horn and convex bottom together produce an oblate spheroid of sound energy affording a substantially uniform amplitude of sound within a large finite horizontal plane at the level of a listener.

15 Claims, 2 Drawing Sheets

CEILING-MOUNTED LOUDSPEAKER

This is a continuation of copending application(s) Ser. No. 07/854,949 filed on Mar. 23, 1992, abandoned.

BACKGROUND OF THE INVENTION

The present invention relates to a ceiling-mounted loudspeaker and in particular to such a speaker which provides a wide included angle of uniform sound coverage over the planned listening area.

Loudspeakers for distributed paging and music systems are often placed in the ceilings of rooms and corridors and are frequently mounted in the suspended ceiling enclosure of the return-air plenum of an architectural space. Because such loudspeakers violate the structural integrity of the ceiling, they must comply with the requirements of building codes generally and, in particular, the building codes relating to fire and smoke protection.

In order to provide uniform sound coverage over a planned listening area (and in particular uniform sound coverage at ear height as a person moves away from the centerline vertical axis perpendicular to the face of the loudspeaker assembly), the coverage angle from that vertical axis must be such that the loudness of the sound, particularly in the speech intelligibility range of 1400 to 5600 Hz, must not vary (e.g., diminish) significantly at ear height as a person moves horizontally relative to (e.g., away from) that vertical axis within the planned listening area. Ideally, the speaker directivity pattern would be an oblate or flattened sphere.

The typical ceiling-mounted loudspeakers are the conventional cone-type loudspeakers facing the floor, the loudspeakers being mounted on metal grills housed in metal boxes that provide code compliance in plenum ceilings. Such assemblies provide downwardly directed cones of sound energy over included coverage angles of about 90 to 120 degrees. Thus, assuming a 12 foot ceiling, such an assembly could provide coverage to about a 7 foot radius from the centerline vertical axis perpendicular to the face (i.e., bottom) of the loudspeaker assembly. Therefore, in order to provide the desired coverage (with an appropriate overlap at the coverage edges), the loudspeakers would have to be mounted on the ceiling no more than about 12 feet apart.

In an attempt to widen the coverage angle, some conventional ceiling-mounted loudspeaker assemblies incorporate reflecting devices disposed below the face of the loudspeaker assembly. However, it has been found that too much of the sound produced by the loudspeaker diffracts around the reflecting device for it to have a significant effect in widening the coverage angle.

While conventional radial horn-type loudspeakers have been ceiling-mounted, these have not proven to be entirely satisfactory in use. Such a radial-type loudspeaker provide a desirably wide angle of coverage, but the loudness of the sound within that coverage angle is not substantially uniform at ear height and significantly diminishes as a person moves towards the axis and directly underneath the loudspeaker.

Accordingly, it is an object of the present invention to provide a ceiling-mounted loudspeaker providing sound coverage over a wide angle.

Another object is to provide such a loudspeaker which provides substantially uniform sound coverage over the planned listening area.

A further object is to provide such a loudspeaker which reduces the number of loudspeakers required for coverage of a given area relative to the number of conventional cone-type ceiling-mounted loudspeakers which would be required.

It is also an object of the present invention to provide such a loudspeaker consisting of various components, but in which only one component needs to comply with building code requirements regarding fire and smoke protection.

SUMMARY OF THE INVENTION

It has now been found that the above and related objects of the present invention are obtained in a ceiling-mounted loudspeaker providing a distribution of sound energy in a plane below the loudspeaker. The loudspeaker comprises a source of sound energy, and a housing supporting the source. The housing includes a passageway for permitting sound energy produced by the source to be directed outside the housing and a bottom wall for causing at least a portion of the sound energy emanating from the passageway to be diffracted and directed toward the vertical axis of the housing, thereby to provide distribution of sound energy both radially from and below the loudspeaker. Preferably the passageway includes opposed walls configured to form a radial horn, and the bottom wall is shaped to form a diffractor on a lower surface of the housing system.

More particularly, the invention encompasses a callings-mounted loudspeaker for creating a generally uniform distribution of sound energy from the loudspeaker. The loudspeaker comprises a first sound-directing structure having a first wall, and a second sound-directing structure having a second wall and coupled to the first sound-directing structure. The first and second walls define a passageway therebetween to direct the flow of sound energy, the second structure including a bottom wall defining a diffraction path for at least some of the sound energy exiting the passageway towards a central vertical axis of the loudspeaker. A loudspeaker driver assembly is disposed in the second sound-directing structure for generating sound energy in response to activation thereof, the sound energy being directed through the passageway and along the bottom wall to create a more uniform distribution of sound energy surrounding the loudspeaker.

In a preferred embodiment of the present invention, the loudspeaker comprises a first or upper sound-directing structure, a second or lower sound direct-directing structure, and a loudspeaker drive assembly. The upper sound-directing structure is substantially in the shape of a first surface of revolution about a substantially vertical axis, for restricting the propagation of sound energy in a first axial direction (i.e., upwardly). The lower sound-directing structure is substantially in the shape of a second surface of revolution about the axis, for restricting the propagation of sound energy in a second axial direction (i.e., downwardly). The upper and lower structures having walls for restricting the propagation of sound energy in the axial direction, the walls defining a passageway therebetween to direct the flow of sound energy. The walls at the input end of the passageway are substantially parallel to the primary direction of motion of a sound-generating piston, and the passageway is substantially expanding in cross-sectional area from the input end to the output mouth of the passageway. The lower structure further has a bottom wall, preferably in the form of continuously convex surface, configured and dimensioned to define a diffraction path for at least some of the sound energy exiting the output of the passageway, thereby creating a more uniform distribution of sound energy surrounding the loudspeaker.

The convex bottom and the wall of the lower structure define an enclosure. A loudspeaker driver assembly disposed in the enclosure has a piston for generating sound energy and directing it in the first axial direction (i.e., upwardly). At least a part of the upper structure is nested in the lower structure and has a surface transverse to the axis for facing a portion of the piston in sufficiently close proximity for cooperation with the piston to force sound energy from the piston away from the axis, between and along the piston and the cooperating surface, and into the passageway. The cooperating surface and the lower structure define an input end to the passageway facing the piston and shaped to receive sound energy emanating substantially solely from piston portions facing the cooperating surface and the input end.

The passageway acts as a radial horn and the convex bottom acts as a downwardly-directed diffractor, together to produce an oblate spheroid of sound energy affording a substantially uniform amplitude of sound within a large finite horizontal plane at the level of a listener.

In an especially preferred embodiment, the enclosure is a sphere or an oblate spheroid. The convex bottom has a monotonic continuous positive curvature and preferably defines a vent about the axis to tune the enclosure and improve low-frequency response. The piston of the driver assembly is equal in cross-sectional area to the input end of the passageway, the driver is devoid of any phase plug, and a damper grill-cloth is disposed intermediate the piston and the input end of the passageway.

BRIEF DESCRIPTION OF THE DRAWING

The above brief description, as well as further objects, features and advantages of the present invention, will be more fully understood by reference to the following detailed description of the presently preferred, albeit illustrative, embodiments of the present invention when taken in conjection with the accompanying drawing wherein.

DETAILED DESCRIPTION OF THE PREFERRED EMBODIMENTS

Figure 1:
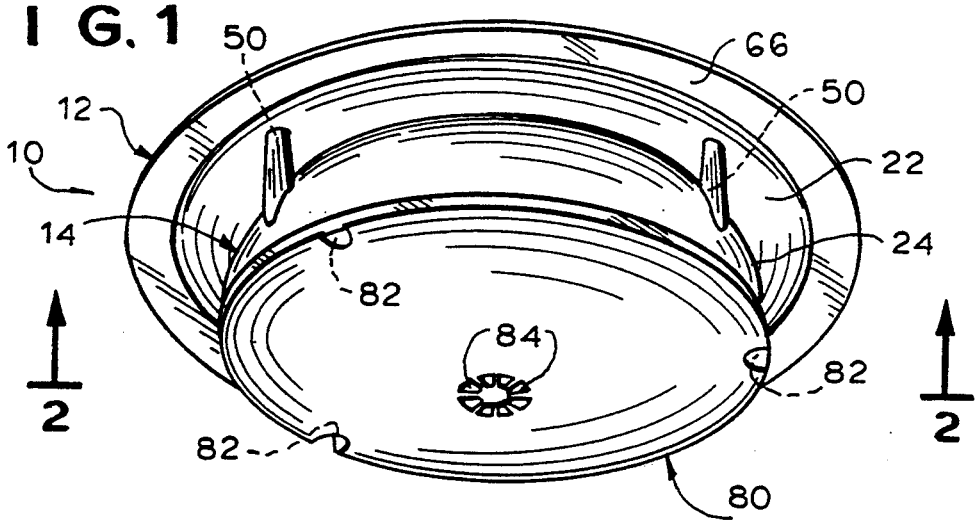
FIG. 1 is an isometric view of a ceiling-mounted loudspeaker according to the present invention.

Referring now to the drawing, and in particular to FIG. 1 thereof, therein illustrated is a ceiling-mounted loudspeaker according to the present invention, generally designated by the reference numeral 10. The loudspeaker 10 comprises a first or upper sound-directing structure, generally designated 12, for restricting the propagation of sound energy in one axial direction and a second or lower sound-directing structure, generally designated 14, for restricting the propagation of sound energy in the other axial direction. More particularly, the first or .upper sound-directing structure 12 is substantially in the shape of a first surface of revolution about a substantially vertical axis and restricts the propagation of sound energy upwardly, while the second or lower sound-directing structure 14 is substantially in the shape of a second surface of revolution about the axis and restricts the propagation of sound energy downwardly. The upper structure 12 defines a wall 22 for restricting the propagation of sound energy upwardly in the axial direction, while the lower structure 14 defines a wall 24 for restricting the propagation of sound energy in the downward axial direction. Thus the walls 22, 24 define a passageway 26 (see FIG. 2) extending 360 degrees about the vertical axis to direct the flow of sound energy outwardly from the vertical axis.

Figure 3:
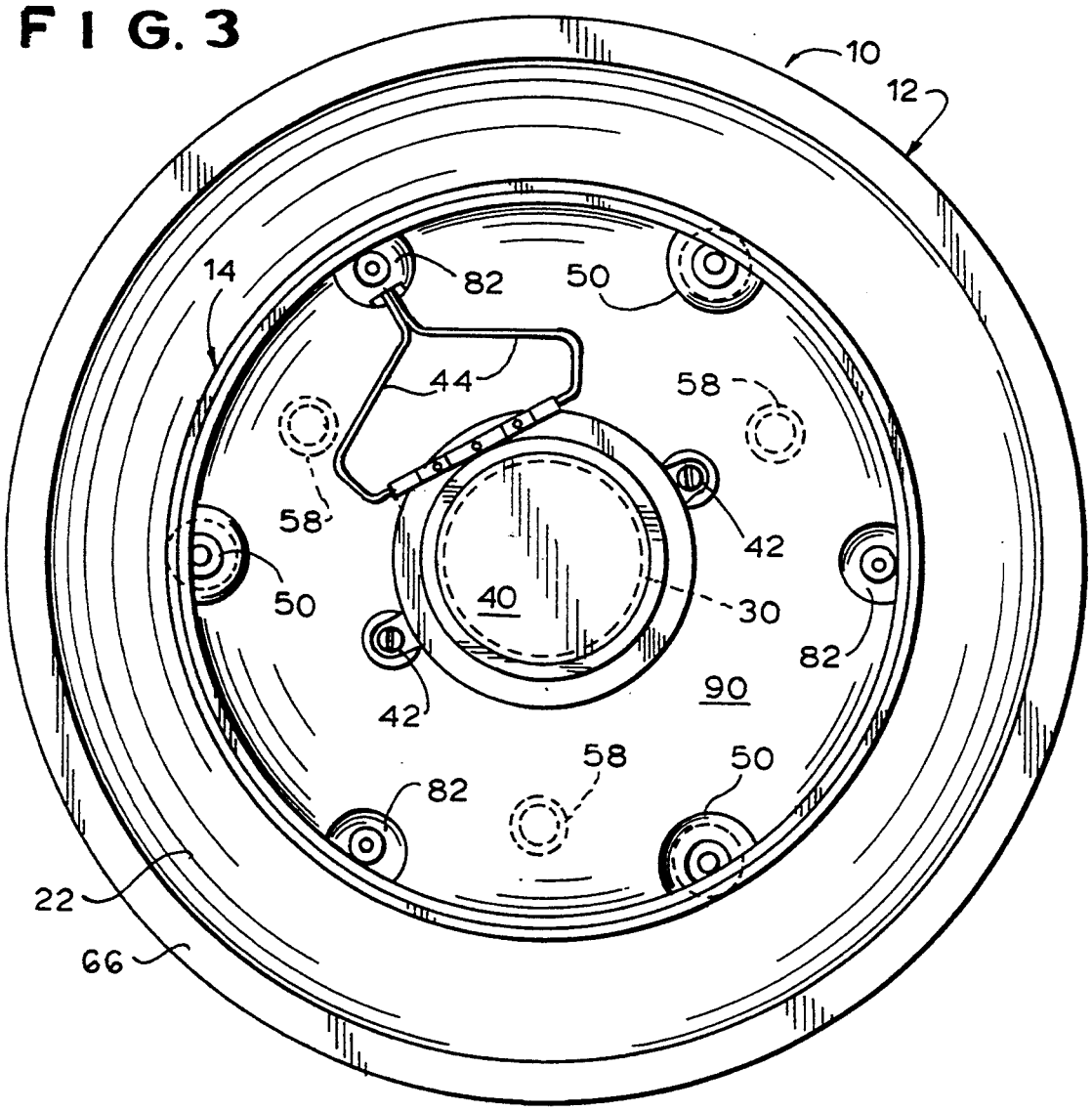
FIG. 3 is a sectional view taken along the line of 3—3 of FIG. 2, with the loudspeaker being shown suspended from a ceiling structure and with a ceiling structure mounting adaptor being illustrated in phantom line.
Figure 2:
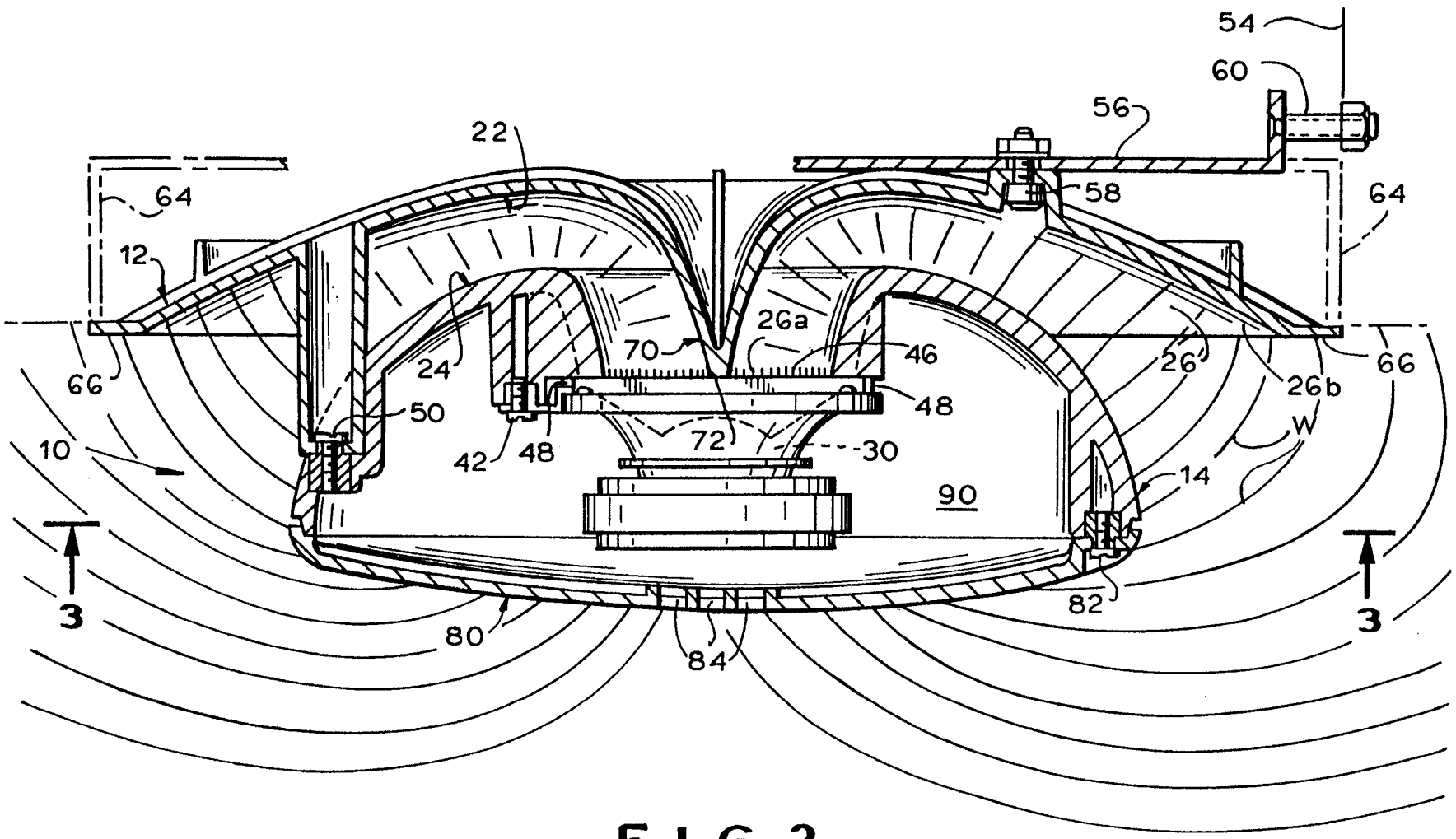
FIG. 2 is a sectional view taken approximately along the line 2—2 of FIG. 1.

Referring now to FIGS. 2 and 3 as well, the walls at the input end or throat **26*a* of the passageway 26 are substantially parallel to the primary direction of propagation of the sound energy, the passageway 26 being substantially expanding in cross-sectional area from the input end 26*a* to the output end or mouth 26*b* of the passageway 26. The spacing of the walls 22, 24 is selected to allow a controlled expansion of the area of the passageway 26 according to a hyperbolic equation (such as an exponential equation). As illustrated by the sound waves W in FIG. 2, the passageway 26 radiates sound energy frequencies above the horn cutoff frequency radially from the horn at a wide coverage angle from the centerline vertical axis of the loudspeaker. As thus described, the upper and lower structures 12, 14 define a passageway 26** which acts like a conventional radial horn providing a desirably wide angle of coverage substantially greater than that obtainable by a comparable ceiling-mounted straight or cone-type loudspeaker. As radial horns of the type described are well known in the loudspeaker art, further details regarding their construction (e.g., configuration, dimensions, materials and the like) will not be provided herein.

A loudspeaker driver assembly, generally designated 40, is secured (for example, by screws 42) to the lower structure 14 and electronically energized via electrical circuit wires 44 (see FIG. 3). The loudspeaker driver assembly 40 includes a reciprocatable piston or diaphragm 30 for generating sound energy in response to energization and directing it upwardly in the axial direction. The piston 30 of the driver assembly 40 is preferably larger than the piston which would be used in a compression horn of comparable size, thereby to assure that the sound energy output from the passageway mouth **26*b*** includes sound energy frequencies present below the cutoff frequency as well as the frequencies present above the cutoff frequency.

It will be appreciated that, in order to ensure sound energy radiation below the horn cutoff frequency, the loudspeaker 10 is preferably not equipped with a phase plug. Accordingly, to mitigate sound energy cancellation effects arising out of the use of an unphased passageway input throat **26*a*, a damper grill-cloth 46 is preferably placed across the front or upper surface of the driver assembly 40 intermediate the piston 30 and the passageway input throat 26*a*. A driver gasket 48 may also be disposed intermediate the driver assembly 40 and the adjacent surface of the lower structure 14 defining the passageway input throat 26*a***.

The driver assembly 40 is mounted on and secured to the lower structure 14 by a pair of mounting screws 42, and the lower structure 14 is mounted on and secured to the upper structure 12 by three mounting screws 50. The upper structure 12, and hence the entire loudspeaker 10, may be mounted to a ceiling structure 54 by means of a plurality of ceiling-mounting brackets 56, only one such bracket 56 being illustrated in FIG. 2. The upper structure 12 is secured to each ceiling-mounting bracket 56 by means of a bolt 58, and each ceiling-mounting bracket is in turn secured to the ceiling structure 54 by means of a bolt 60.

If desired and available, a plenum ceiling structure 54 may be provided with a flush mounting adaptor 64, illustrated in phantom line in FIG. 2, so that the portion of the loudspeaker 10 above a peripheral mounting rim 66 of the upper structure 12 (and this includes most of the upper structure 12 and at least a portion of the lower structure 14) is concealed within the adaptor 64. However it will be really apparent to those skilled in the loudspeaker art that other means may be used for mounting the loudspeaker drive assembly 40 to the lower structure 14, for mounting the lower structure 14 to the upper structure 12, and for mounting the upper structure 12 to a ceiling structure 54.

The center portion 70 of the upper structure 12 is nested in the lower structure 14 (and in the passageway throat 26*a*) and has a surface 72 at least partially transverse to the axis for facing a portion of the piston 30 in sufficiently close proximity for cooperation with the piston 30 to force sound energy from the piston 30 away from the vertical axis, between and along the piston 30 and the cooperating surface 72, and into the passageway 26. The cooperating surface 72 and the second structure 14 define the passageway input end 26*a* facing the piston 30 and are shaped to receive sound energy emanating substantially solely from the piston portions facing the cooperating surface 72 and the passageway throatut end 26*a*.

It is a critical feature of the present invention that the lower structure 14 has a bottom wall, generally designated 80, which is preferably continuous and convex. The bottom wall 80 is configured and dimensioned to define a diffraction path for at least some of the sound energy exiting the passageway output mouth 26*b*. Bottom wall 80 is secured to the wall 24 of the lower structure 14 by screws 82, thereby to define an enclosure 90 wherein the loudspeaker driver assembly 40 is disposed. Preferably, bottom wall 80 preferably has a monotonic (that is, non-wavy) and continuous positive curvature.

Bottom wall 80 desirably includes vents 84 about the vertical axis to enable tuning of the enclosure 90 and to improve the low-frequency response thereof. The disposition of the vents 84 closely adjacent to the vertical axis of the loudspeaker 10 does not interfere with the essentially continuous nature of bottom wall 80 which, except for the vents 84, is smooth and without interruption.

As illustrated in FIG. 2, the sound path for at least some of the sound energy emerging from the radial horn or passageway outlet mouth 26*b* continues, by diffraction, around the bottom wall 80 of the enclosure 90 toward the vertical axis (that is, directly below the loudspeaker 10). Because this diffraction path is less efficient than the radial horn path alone, radiation below the loudspeaker is less than it would be with a conventional downwardly directed cone-type assembly. However, the shorter distance of the travel path of sound energy from the bottom wall 80 to the ear of the listener positioned directly below loudspeaker 10, relative to the travel path from the passageway output mouth 26*b* to the ear of the listener positioned remotely from the vertical axis, compensates for the lower efficiency of the radial horn plus diffraction path, relative to the radial horn path alone. Additionally, sound energy from the optional vents 84 reinforces the low or bass frequency of the sound energy and provides a path for sound energy leaking from the back or bottom of the loudspeaker driver assembly 40. As a result, the passageway 26 (acting as a radial horn) and the bottom wail 80 (acting as a downwardly-directed diffractor) cooperate together to produce an oblate spheroid of sound energy affording a substantially uniform amplitude of sound within a large finite horizontal plane at the level of a listener.

Theoretically an ideal loudspeaker 10 according to the present invention would incorporate an upper structure 12 having a planar wall 22 and an enclosure 90 which was a sphere. In such an embodiment, plane sound waves would be produced by the driver assembly, and these plane sound waves would become spherical as they exited the horn and diffracted or bent around the sphere defined by the enclosure 90. The only limitation on the angle of coverage would be the size of the loudspeaker, and there does not appear to be an upper limit on that size. The minimum size of the loudspeaker should be that which allows all speech coverage frequencies above 1400 Hz to be above the horn cutoff frequency.

As a practical matter, however, the size and configuration of the loudspeaker must be tempered by considerations of what is both mechanically and visually acceptable in ordinary building construction. Accordingly, in a preferred practical embodiment the enclosure 90 is not a sphere but rather an oblate spheroid having a substantially flattened convex bottom 80. The illustrated design provides an included angle of coverage of about 150 degrees. Thus, for a 12 foot ceiling, whereas the conventional cone-type loudspeaker provides coverage to about a 7 foot radius, the loudspeaker 10 of the present invention provides coverage to a 22 foot radius, about triple that of the conventional loudspeaker. Therefore, with loudspeakers 10 according to the present invention, in a room one-ninth the number of speakers would be required, and, in a narrow corridor one-third the number of speakers would be required.

A further advantage of the loudspeaker 10 of the present invention is that only the upper structure 12 must comply with building code requirements for plenum ceilings, and the lower structure 14 (and the driver assembly 40 therewithin) need not.

To summarize, the present invention provides a ceiling-mounted loudspeaker which provides not only sound coverage over a wide angle, but substantially uniform sound coverage over the plane of the intended listening area. The loudspeaker reduces the number of loudspeakers required for coverage of a given area relative to the number of conventional cone-type ceiling-mounted loudspeakers which would be required and only one of the various components thereof must comply with building code requirements regarding fire and smoke protection.

Now that the preferred embodiments of the present invention have been shown and described in detail, various modifications and improvements thereon will become readily apparent to those skilled in the art. Accordingly, the spirit and skill of the present invention is to be construed broadly and limited only by the appended claims, and not by the foregoing specification.

I claim:

1. A ceiling mounted loudspeaker providing a distribution of sound energy in a plane below the loudspeaker, comprising:

(A) a source of sound energy directing said sound energy upwardly; and (B) a housing supporting said source and including a first portion defining a passageway having a gradual hyperbolic cross-sectional area expansion for permitting sound energy produced by said source to be directed outside said housing and a second portion defining a bottom wall of monotonic continuous positive curvature for causing at least a portion of said sound energy emanating from said passageway to be diffracted downwardly and toward the vertical axis of said housing, said first and second portions being contiguous and continuous;

thereby to provide a distribution of sound energy both radially from and below said loudspeaker.

2. The loudspeaker of claim 1 wherein said passageway includes opposed walls configured to form a radial horn, and said bottom wall is shaped to form a diffractor on a lower surface of said housing.

3. The loudspeaker of claim 1 wherein said housing first portion includes an axial throat-like passageway means for concentrating the sound energy in an upwards direction and a radial horn-like passageway means radially disposed about said axial passageway means for permitting sound energy produced by said source to be directed radially outside said housing, each of said axial and radial passageway means having a gradual hyperbolic cross-sectional area expansion, said axial passageway means expansion blending into said radial passageway expansion means.

4. A ceiling-mounted loudspeaker for creating a generally uniform distribution of sound energy from said loudspeaker, comprising:

(A) a first sound-directing structure having a first wall;

(B) a second sound-directing structure having a second wall and coupled to said first sound-directing structure, said first and second walls defining a passageway therebetween to direct the flow of sound energy, said second structure including as a continuous portion thereof a bottom wall defining a diffraction path for at least some of the sound energy exiting said passageway downwardly and towards a central vertical axis of said loudspeaker; and (C) a loudspeaker driver assembly disposed in said second sound-directing structure for generating sound energy in response to activation thereof, said sound energy being directed upwardly, then through said passageway and finally along said bottom wall to create a more uniform distribution of sound energy surrounding said loudspeaker.

5. The loudspeaker of claim 4 wherein said housing first portion includes an axial throat-like passageway means for concentrating the sound energy in an upwards direction and a radial horn-like passageway means radially disposed about said axial passageway means for permitting sound energy produced by said source to be directed radially outside said housing, each of said axial and radial passageway means having a gradual hyperbolic cross-sectional area expansion, said axial passageway means expansion blending into said radial passageway expansion means.

6. A ceiling-mounted loudspeaker for directing sound energy, said loudspeaker comprising:

(A) a first sound-directing structure, substantially in the shape of a first surface of revolution about a substantially vertical axis, for restricting the propagation of sound energy upwardly in one axial direction;

(B) a second sound-directing structure, substantially in the shape of a second surface of revolution about said axis, for restricting the propagation of sound energy downwardly in the other axial direction, said first and second structures having walls for restricting the propagation of sound energy in the axial direction, said walls defining a passageway therebetween having a gradual hyperbolic cross-sectional area expansion to direct the flow of sound energy, said walls at the input end of said passageway being substantially parallel to the primary direction of motion of a sound-generating piston and said passageway being substantially expanding in cross-sectional area from the input end to the output mouth of said passageway, said second structure further having continuous with and contiguous to the output mouth of said passageway a continuously convex bottom of monotonic continuous positive curvature configured and dimensioned to define a diffraction path downwardly in said other axial direction for at least some of the sound energy exiting the output mouth of said passageway, said convex bottom and said wall of said second structure defining an enclosure; and (C) a loudspeaker driver assembly disposed in said enclosure and having a piston for generating sound energy and directing it upwardly in said one axial direction;

at least a part of said first structure being nested in said second structure and having a surface transverse to said axis for facing a portion of said piston in sufficiently close proximity for cooperation with said piston to force sound energy from said piston away from said axis, between and along said piston and said cooperating surface, and into said passageway; said cooperating surface and said second structure defining said input end to said passageway facing said piston and shaped to receive sound energy emanating substantially solely from piston portions facing said cooperating surface and said input end.

7. The loudspeaker of claim 6 wherein said passageway acts as a radial horn and said convex bottom acts as a downwardly-directed diffractor, together to produce an oblate spheroid of sound energy affording a substantially uniform amplitude of sound within a large finite horizontal plane at the level of a listener.

8. The loudspeaker of claim 6 wherein said enclosure is an oblate spheroid.

9. The loudspeaker of claim 6 wherein said enclosure is a sphere.

10. The loudspeaker of claim 6 wherein said convex bottom defines a vent about said axis to tune said enclosure and improve low-frequency response.

11. The loudspeaker of claim 6 wherein said piston is equal in cross-sectional area to the input throat of said passageway.

12. The loudspeaker of claim 6 wherein said driver is devoid of any phase plug, and a damper grill-cloth is disposed intermediate said piston and said input end of said passageway.

13. The loudspeaker of claim 6 wherein said housing first portion includes an axial throat-like passageway means for concentrating the sound energy in an upwards direction and a radial horn-like passageway means radially disposed about said axial passageway means for permitting sound energy produced by said source to be directed radially outside said housing, each of said axial and radial passageway means having a gradual hyperbolic cross-sectional area expansion, said axial passageway means expansion blending into said radial passageway expansion means.

14. A ceiling-mounted loudspeaker for directing sound energy, said loudspeaker comprising:

(A) a first sound-directing structure, substantially in the shape of a first surface of revolution about a substantially vertical axis, for restricting the propagation of sound energy upwardly in one axial direction;

(B) a second sound-directing structure, substantially in the shape of a second surface of revolution about said axis, for restricting the propagation of sound energy downwardly in the other axial direction, said first and second structures having walls defining a passageway therebetween to direct the flow of sound energy from an input throat, said passageway walls being substantially parallel to the primary direction of motion of a sound-generating piston, said passageway being substantially expanding in cross-sectional area from the input throat to the output mouth of said passageway, said second structure further having a convex bottom with a monotonic continuous curvature configured and dimensioned to define a downward diffraction path for at least some of the sound energy exiting the output mouth of said passageway, said convex bottom and said wall of said second structure defining an enclosure in the configuration of an oblate spheroid, said convex bottom defining a vent about said axis to tune said enclosure and improve low-frequency response;

(C) a loudspeaker driver assembly disposed in said enclosure and having a piston equal in cross-sectional area to the input throat of said passageway for generating sound energy and directing it upwardly in said one axial direction, said driver assembly being devoid of any phase plug; and (D) a damper grill-cloth disposed intermediate said piston and said input end of said passageway;

at least a part of said first structure being nested in said second structure and having a surface transverse to said axis for facing a portion of said piston in sufficiently close proximity for cooperation with said piston to force sound energy from said piston away from said axis between and along said piston and said cooperating surface and into said passageway; said cooperating surface and said second structure defining said input throat to said passageway facing said piston and shaped to receive sound energy emanating substantially solely from piston portions facing said cooperating surface and said input end;

whereby said passageway acts as a radial horn and said convex bottom acts as a downwardly-directed diffractor, together to produce an oblate spheroid of sound energy affording a substantially uniform amplitude of sound within a large finite horizontal plane at the level of a listener.

15. The loudspeaker of claim 14 wherein said housing first portion includes an axial throat-like passageway means for concentrating the sound energy in an upwards direction and a radial horn-like passageway means radially disposed about said axial passageway means for permitting sound energy produced by said source to be directed radially outside said housing, each of said axial and radial passageway means having a gradual hyperbolic cross-sectional area expansion, said axial passageway means expansion blending into said radial passageway means expansion.

* * * * *